US010096914B1

(12) United States Patent
Kuo et al.

(10) Patent No.: US 10,096,914 B1
(45) Date of Patent: Oct. 9, 2018

(54) FLOATING CONNECTOR AND CONDUCTIVE TERMINAL THEREOF

(71) Applicant: Greenconn Corporation, New Taipei (TW)

(72) Inventors: Tsung-Lung Kuo, Taipei (TW); Jiun-Fu Ke, New Taipei (TW)

(73) Assignee: GREENCONN CORP., New Taipei (TW)

( * ) Notice: Subject to any disclaimer, the term of this patent is extended or adjusted under 35 U.S.C. 154(b) by 0 days.

(21) Appl. No.: 15/815,531

(22) Filed: Nov. 16, 2017

(51) Int. Cl.

| | |
|---|---|
| ***H01R 13/629*** | (2006.01) |
| ***H01R 9/26*** | (2006.01) |
| ***H01R 13/631*** | (2006.01) |
| ***H01R 13/428*** | (2006.01) |

(52) U.S. Cl.
CPC ..... *H01R 9/2616* (2013.01); *H01R 13/428* (2013.01); *H01R 13/6315* (2013.01)

(58) Field of Classification Search
CPC ..... H01R 12/91
USPC ..... 439/247, 248
See application file for complete search history.

(56) References Cited

U.S. PATENT DOCUMENTS

| | | | | |
|---|---|---|---|---|
| 6,773,283 | B2 * | 8/2004 | Yoshimatsu | H01R 12/714 200/51.05 |
| 7,040,904 | B2 * | 5/2006 | Kajimoto | H01R 13/6315 439/247 |
| 7,125,260 | B2 * | 10/2006 | Orita | H01R 12/57 439/74 |
| 7,862,345 | B2 * | 1/2011 | Fukazawa | H01R 12/716 439/74 |
| 9,178,326 | B2 * | 11/2015 | Funayama | H01R 12/91 |
| 9,887,484 | B1 * | 2/2018 | Hu | H01R 13/502 |
| 2017/0170588 | A1 * | 6/2017 | Doi | H01R 12/7005 |

* cited by examiner

*Primary Examiner* — Neil Abrams
(74) *Attorney, Agent, or Firm* — Li & Cai Intellectual Property (USA) Office

(57) ABSTRACT

A floating connector includes an inserting chamber and a plurality of conductive terminals. The inserting chamber includes two opposite side walls each having a plurality of fixing portions. The conductive terminals are respectively fastened to the fixing portions of the inserting chamber. Each conductive terminal includes a contact segment, a curved segment, an elastic segment, and a fixing segment. The contact segment is arranged in the inserting chamber. A first end of the curved segment is connected to the contact segment, and an opposite second end of the curved segment is fixed to the corresponding fixing portion. Two opposite ends of the elastic segment are respectively connected to the second end of the curved segment and the fixing segment. The inserting chamber is movable relative to the fixing segments, and the elastic segments can provide an elastic force to the inserting chamber by being pressed.

8 Claims, 9 Drawing Sheets

FLOATING CONNECTOR AND CONDUCTIVE TERMINAL THEREOF

BACKGROUND OF THE INVENTION

1. Field of the Invention

The present disclosure relates to a connector; in particular, to a floating connector and a conductive terminal thereof.

2. Description of Related Art

The conventional floating connector includes an inserting chamber and a plurality of conductive terminals installed in the inserting chamber. The inserting chamber is movable relative to the conductive terminals, and the conductive terminals can provide an elastic force to the inserting chamber for achieving a shockproof function. However, the structure of each conductive terminal of the conventional floating connector needs to be improved for providing a better shockproof function. Moreover, the performance of the conductive terminals of the conventional floating connector are limited due to the cooperation between the conductive terminals and the inserting chamber (e.g., each conductive terminal has an elastic segment and two fixing portions respectively arranged at two opposite sides of the elastic segment, and the two fixing portions of each conductive terminal are fixed on the inserting chamber).

SUMMARY OF THE INVENTION

The present disclosure provides a floating connector and a conductive terminal thereof to solve the drawback associated with conventional floating connectors.

The present disclosure provides a floating connector, which includes an insulating housing and a plurality of conductive terminals. The insulating housing includes an elongated inserting chamber defining a longitudinal direction. The inserting chamber includes a top wall and two opposite side walls, each of the two side walls has a plurality of fixing portions arranged on an outer surface thereof, and the fixing portions of each of the two side walls are arranged in one row parallel to the longitudinal direction and are arranged away from the top wall. The conductive terminals are respectively fastened to the fixing portions of the inserting chamber and arranged in two rows each being parallel to the longitudinal direction. Each of the conductive terminals is integrally formed as one piece and includes a contact segment, a curved segment, an elastic segment, and a fixing segment. The contact segment is inserted into the inserting chamber in a height direction. The curved segment has a first end connected to the contact segment and an opposite second end fixed on the corresponding fixing portion. The elastic segment and the fixing segment are arranged outside the inserting chamber. Two opposite ends of the elastic segment are respectively connected to the second end of the curved segment and the fixing segment. The conductive terminals are arranged in a mirror symmetry with respect to the inserting chamber, bottom surfaces of the fixing segments of the conductive terminals are substantially arranged on a plane, and the inserting chamber is spaced apart from the plane. The insulating housing is movable relative to the fixing segments, so that each of the elastic segments can be pressed to provide an elastic force to the insulating housing.

The present disclosure also provides a floating connector, which includes an inserting chamber and a plurality of conductive terminals. The inserting chamber includes a top wall and two opposite side walls. Each of the two side walls has a plurality of fixing portions. The conductive terminals are respectively fastened to the fixing portions of the inserting chamber. Each of the conductive terminals is integrally formed as one piece and includes a contact segment, a curved segment, an elastic segment, and a fixing segment. The contact segment is arranged in the inserting chamber. The curved segment has a first end connected to the contact segment and an opposite second end fixed on the corresponding fixing portion. The elastic segment and the fixing segment are arranged outside the inserting chamber. Two opposite ends of the elastic segment are respectively connected to the second end of the curved segment and the fixing segment. The inserting chamber is movable relative to the fixing segments, so that each of the elastic segments can be pressed to provide an elastic force to the inserting chamber.

The present disclosure further provides a conductive terminal of a floating connector. The conductive terminal includes a contact segment, a curved segment, an elastic segment, and a fixing segment. The curved segment is substantially a U-shape and has a first end and an opposite second end, in which the first end is connected to the contact segment. Two opposite ends of the elastic segment are respectively connected to the second end of the curved segment and the fixing segment, the elastic segment is substantially a U-shape, and a central axis of the elastic segment and a central axis of the curved segment have an acute angle. A portion of the contact segment arranged adjacent to the curved segment extends from the curved segment in a first direction, a portion of the fixing segment arranged adjacent to the elastic segment extends from the elastic segment in a second direction, and the first direction and the second direction are parallel to each other and extend in opposite directions.

In summary, the floating connector and the conductive terminal of the present disclosure can be provided with a better shockproof effect by the structural design of the conductive terminal. Moreover, the cooperation of the conductive terminals and the inserting chamber can be provided to prevent the insulating housing from limiting the performance of the conductive terminals, thereby effectively improving the shockproof effect of the floating connector.

In order to further appreciate the characteristics and technical contents of the present disclosure, references are hereunder made to the detailed descriptions and appended drawings in connection with the present disclosure. However, the appended drawings are merely shown for exemplary purposes, and should not be construed as restricting the scope of the present disclosure.

DETAILED DESCRIPTION OF THE PREFERRED EMBODIMENTS

Reference is made to FIGS. 1 to 9, which illustrate an embodiment of the present disclosure. References are hereunder made to the detailed descriptions and appended drawings in connection with the present disclosure. However, the appended drawings are merely provided for exemplary purposes, and should not be construed as restricting the scope of the present disclosure.

Figure 1:
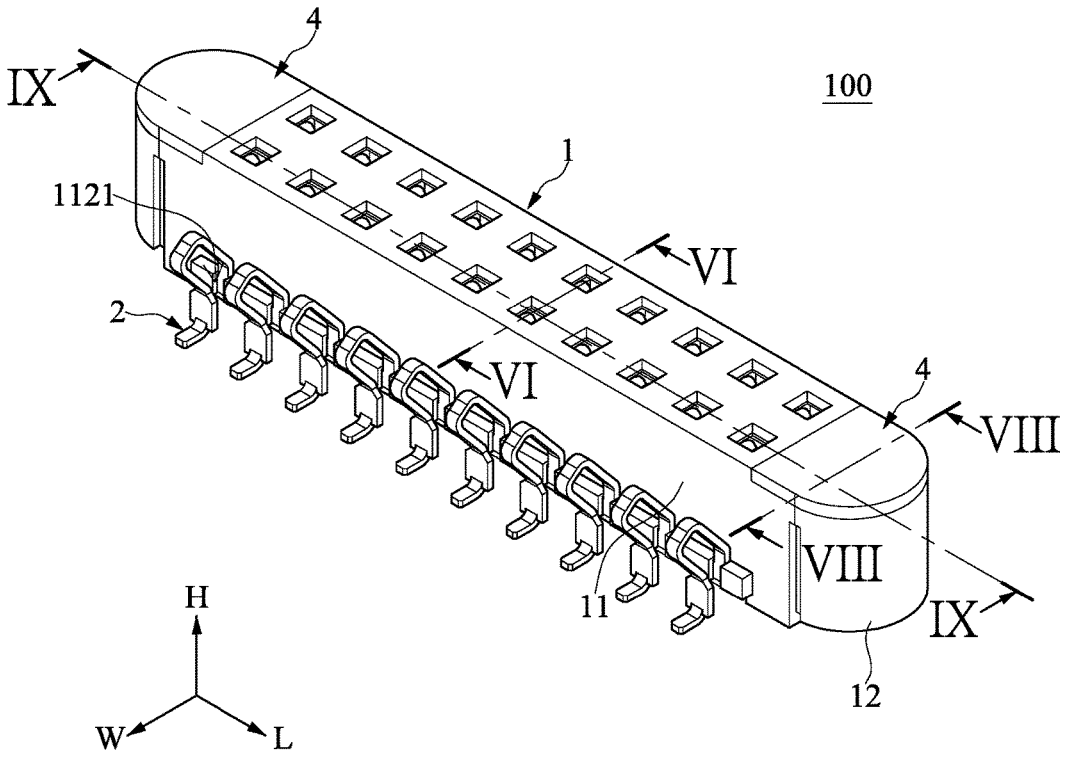
FIG. 1 is a perspective view showing a floating connector according to the present disclosure.
Figure 2:
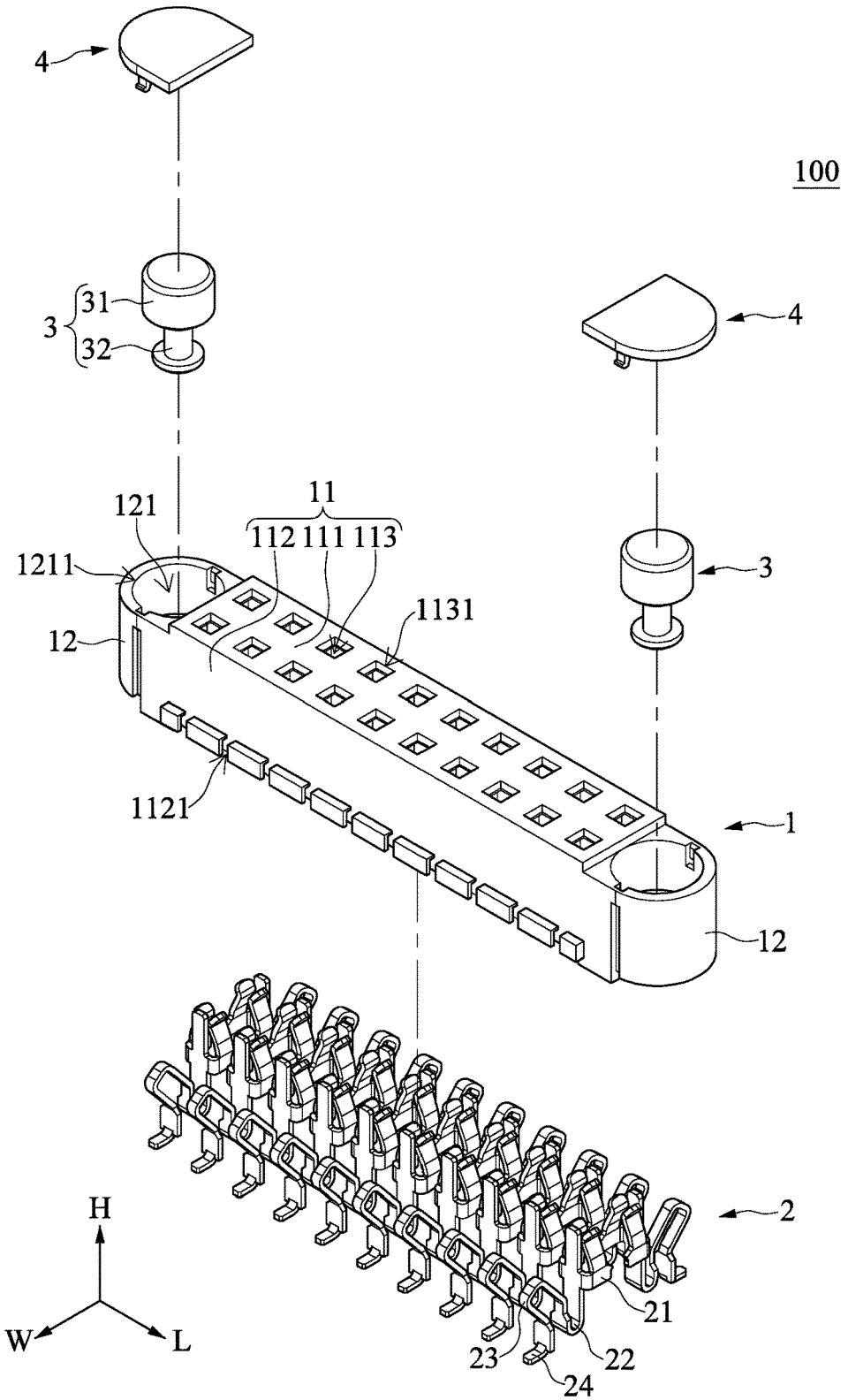
FIG. 2 is an exploded view of FIG. 1.
Figure 3:
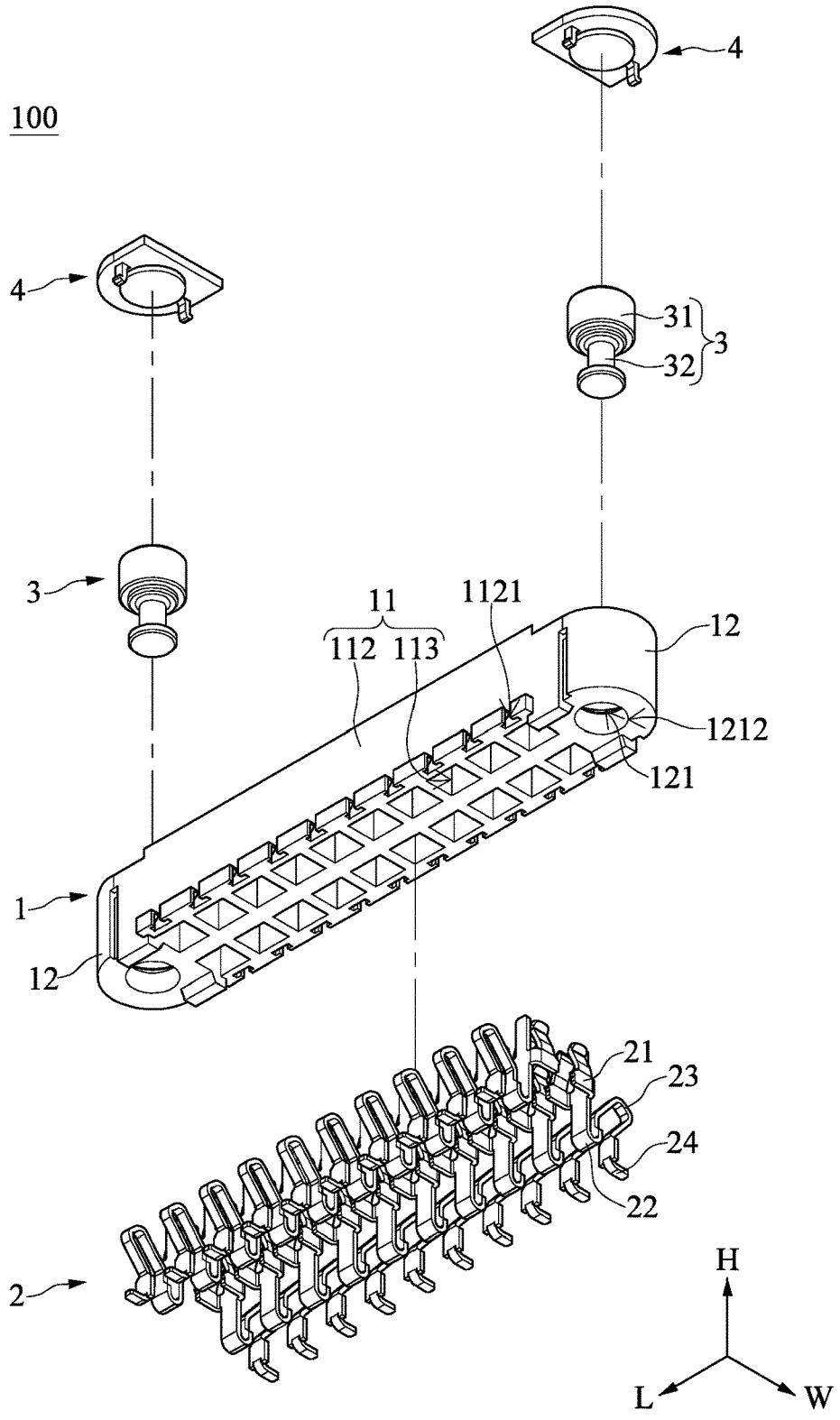
FIG. 3 is an exploded view of FIG. 1 from another perspective.

As shown in FIGS. 1 to 3, the present embodiment provides a floating connector 100 for inserting into a mating connector (not shown) and being applied to a movable object (e.g., a car). When the floating connector 100 is moved relative to the mating connector, the structural design of the floating connector 100 enables the electrical connection between the floating connector 100 and the mating connector to be firmly maintained.

The floating connector 100 of the present embodiment includes an insulating housing 1, a plurality of conductive terminals 2 fastened to the insulating housing 1, two positioning posts 3 movably arranged in the insulating housing 1, and two end covers 4 detachably fixed on the insulating housing 1. The following description discloses the structure and connection of each component of the floating connector 100.

The conductive terminals 2 are described as being cooperated with the insulating housing 1 in the present embodiment, but the present disclosure is not limited thereto. That is to say, the conductive terminal 2 can also be applied with other components. Moreover, in other embodiments of the present disclosure, the floating connector 100 can be provided without the two positioning posts 3, the two end covers 4, and a portion of the insulating housing 1 corresponding to the two positioning posts 3 and the two end covers 4.

As shown in FIGS. 2 and 3, the insulating housing 1 in the present embodiment is integrally formed as one piece and includes an elongated inserting chamber 11 and two positioning chambers 12 respectively arranged at two opposite sides of the inserting chamber 11 (i.e., the left side and the right side of the inserting chamber 11 as shown in FIG. 2). To facilitate easy understanding of the present embodiment, the inserting chamber 11 is defined with a longitudinal direction L, a height direction H, and a width direction W, which are perpendicular to each other.

The inserting chamber 11 includes a top wall 111 and two opposite side walls 112, and an inner portion of the inserting chamber 11 has a plurality of terminal slots 113 each penetratingly formed along the height direction H of the inserting chamber 11. Each of the terminal slots 113 has an insertion opening 1131 formed in the top wall 111, and the insertion openings 1131 of the terminal slots 113 are arranged in two rows each parallel to the longitudinal direction L. In other words, the terminal slots 113 are arranged in two rows each parallel to the longitudinal direction L.

Each of the two side walls 112 has a plurality of fixing portions 1121 arranged on an outer surface thereof, and the fixing portions 1121 of each of the two side walls 112 are arranged in one row parallel to the longitudinal direction L and are arranged away from the top wall 111. In the present embodiment, the outer surface of each of the two side walls 112 has an elongated rib parallel to the longitudinal direction L and arranged away from the top wall 111. Each of the ribs has a plurality of notches recessed from a lower side to an upper side thereof, and each of the notches is defined as a fixing portion 1121, but the structure of each fixing portion 1121 is not limited thereto.

Figure 6:
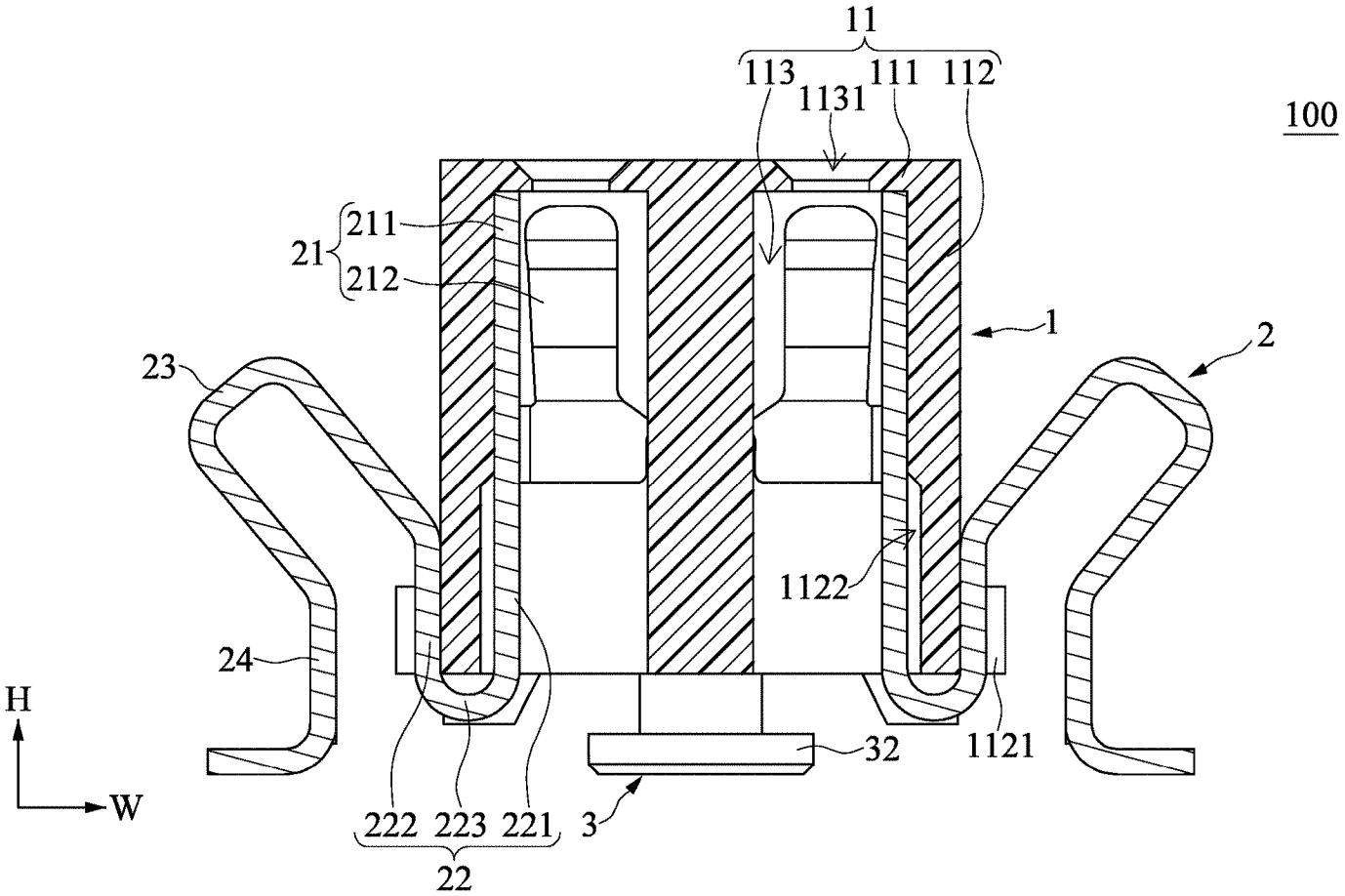
FIG. 6 is a cross-sectional view taken along the cross-sectional line VI-VI of FIG. 1.

Moreover, each of the two side walls 112 has a plurality of grooves 1122 (as shown in FIG. 6) formed in an inner surface thereof and arranged away from the top wall 111. The grooves 1122 are respectively arranged in the terminal slots 113, and each of the grooves 1122 is recessed in the inner surface of the corresponding side wall 112 and is parallel to the height direction H, but the present disclosure is not limited thereto.

Figure 8:
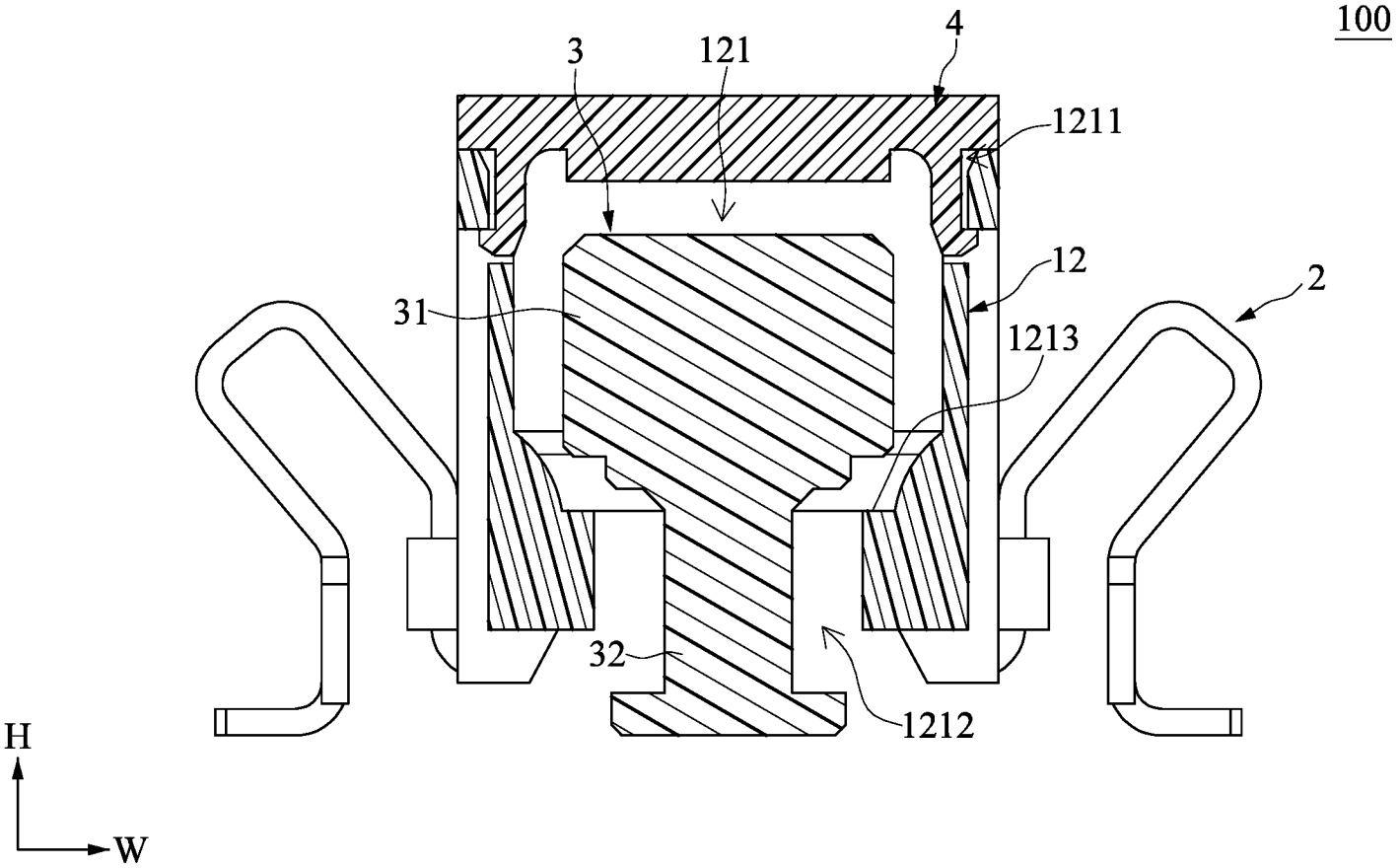
FIG. 8 is a cross-sectional view taken along the cross-sectional line of FIG. 1.

The two positioning chambers 12 respectively and integrally extend from two opposite short ends of the inserting chamber 11, and each of the two positioning chambers 12 has a limiting slot 121 penetratingly formed in the height direction H. The limiting slot 121 of each of the two positioning chambers 12 has a big opening 1211 and a small opening 1212 respectively arranged on two opposite sides thereof (i.e., the top side of the positioning chamber 12 as shown in FIG. 2, and the bottom side of the positioning chamber 12 as shown in FIG. 3). As shown in FIG. 8, an upper half space of each positioning slot 121 is larger than a lower half space of each positioning slot 121, and an inner surface of each positioning slot 121 has a limiting step surface 1213 arranged between the upper half space and the lower half space, but the present disclosure is not limited thereto.

As shown in FIGS. 1 to 3, the conductive terminals 2 are respectively fastened to the fixing portions 1121 of the inserting chamber 11 and are arranged in two rows each parallel to the longitudinal direction L. The conductive terminals 2 in the present embodiment are preferably arranged in a mirror symmetry with respect to the inserting chamber 11, but the present disclosure is not limited thereto. The conductive terminals 2 are respectively arranged in the terminal slots 113 of the inserting chamber 11 and respectively correspond in position to the insertion openings 1131.

As the conductive terminals 2 in the present embodiment are of the same structure, the following description only discloses the structure of one of the conductive terminals 2 and a corresponding portion of the inserting chamber 11 (i.e., the corresponding terminal slot 113 and the corresponding fixing portion 1121) for the sake of brevity. However, in other embodiments of the present disclosure, the conductive terminals 2 can be formed in different structures.

Figure 4:
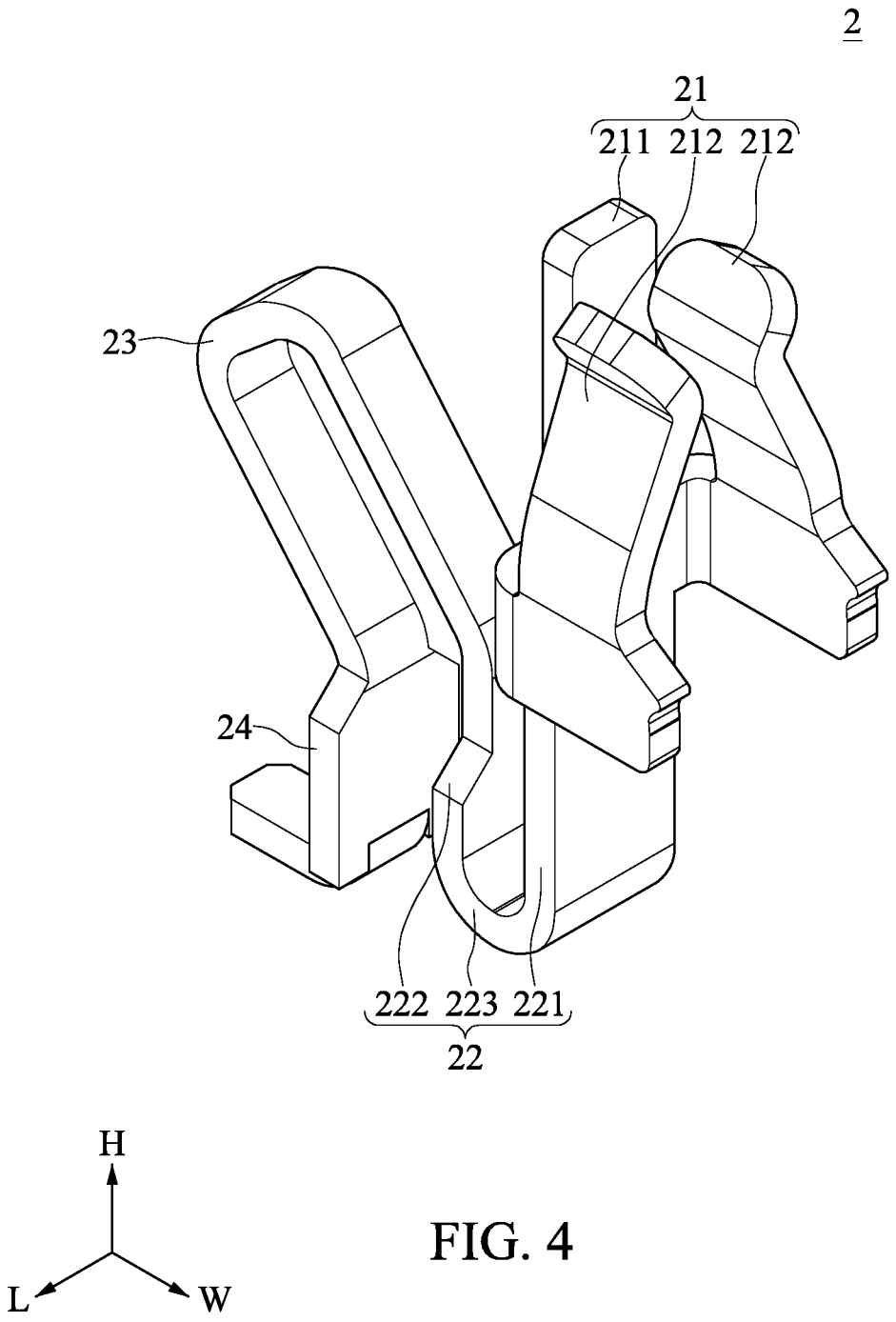
FIG. 4 is a perspective view showing a conductive terminal of the floating connector according to the present disclosure.
Figure 5:
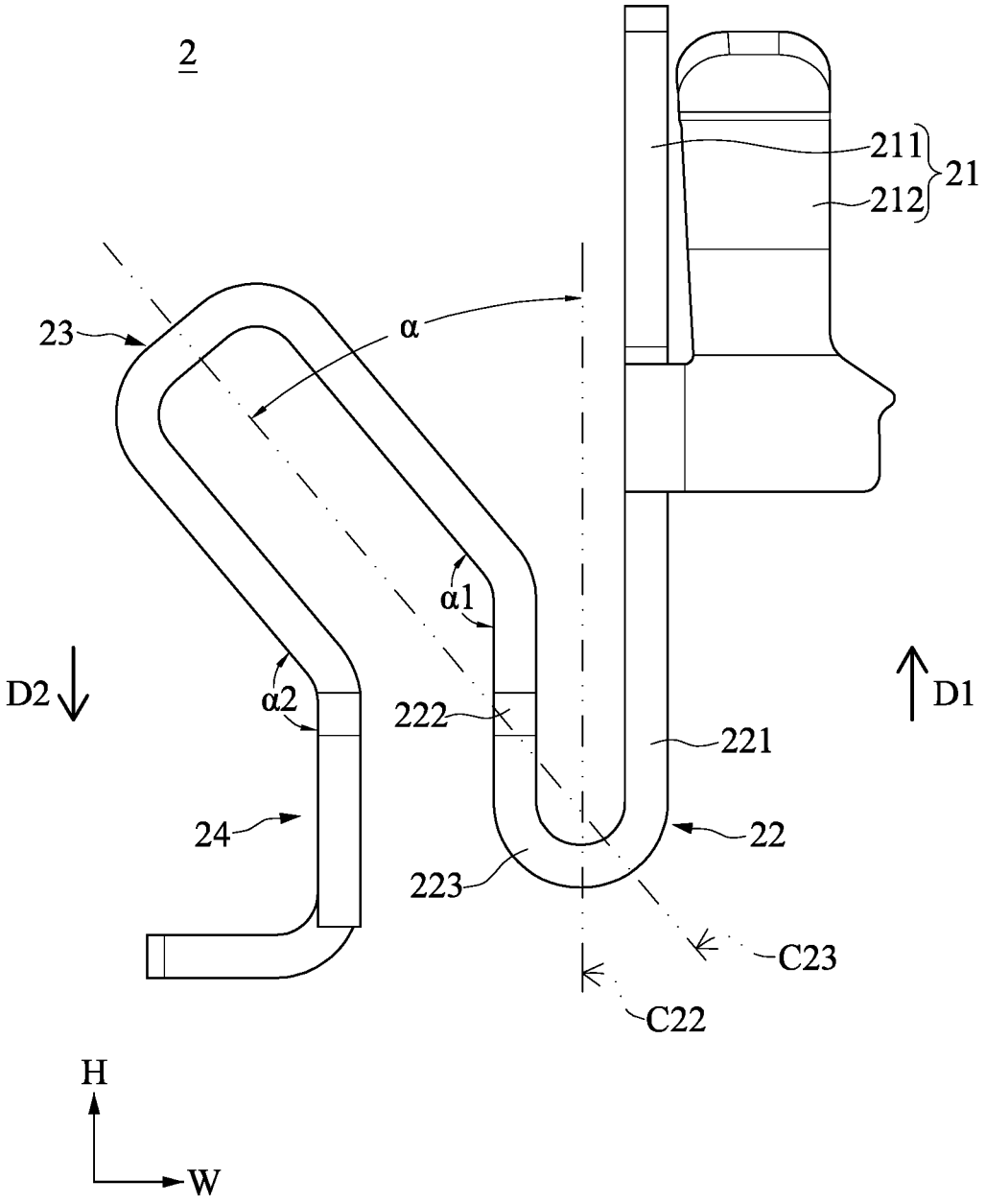
FIG. 5 is a planar view of FIG. 4.

As shown in FIGS. 4 to 6, the conductive terminal 2 is integrally formed as one piece and includes a contact segment 21, a curved segment 22, an elastic segment 23, and a fixing segment 24, which are arranged in sequence. That is to say, the curved segment 22 has a first end connected to the contact segment 21 and an opposite second end, and two opposite ends of the elastic segment 23 are respectively connected to the second end of the curved segment 22 and the fixing segment 24.

Figure 9:
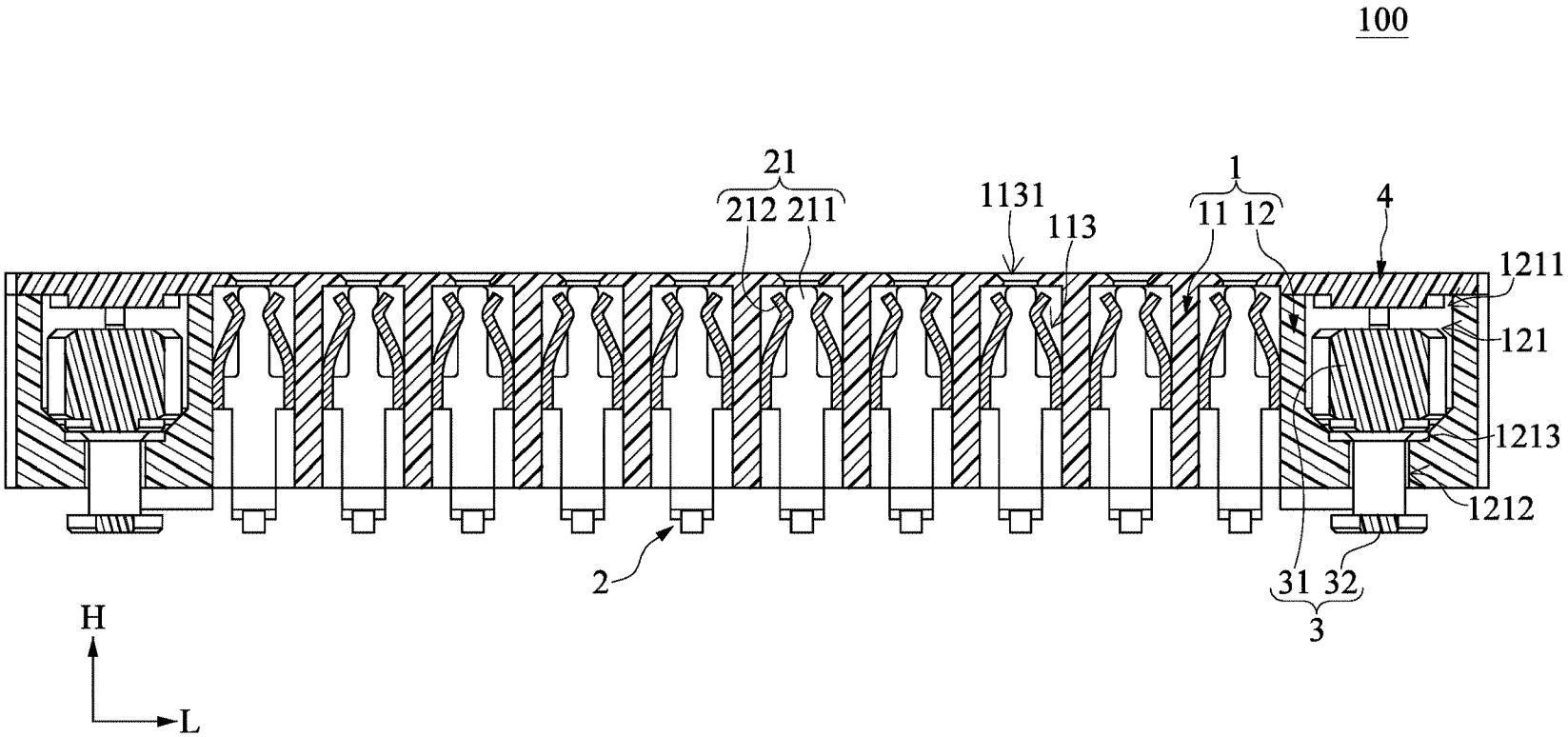
FIG. 9 is a cross-sectional view taken along the cross-sectional line IX-IX of FIG. 1.

Specifically, the contact segment 21 is inserted into the corresponding terminal slot 113 of the inserting chamber 11 in the height direction H. The conductive terminal 2 includes an extending sheet 21 having an elongated flat shape and two clamping sheets 22 respectively and extending curvedly from two opposite side edges of the extending sheet 21. The extending sheet 21 is flatly abutted against the inner surface of the corresponding side wall 112, and a bottom portion of each clamping sheet 22 preferably pierces into the inner surface of the corresponding terminal slot 113. Moreover, the extending sheet 211 and free ends of the two clamping sheets 212 of the conductive terminal 2 are preferably arranged outside a projecting space defined by orthogonally projecting the corresponding insertion opening 1131 toward the terminal slot 113 in the height direction H (as shown in FIGS. 6 and 9).

The curved segment 22 includes an internal portion 221 connected to the contact segment 21, an external portion 222 connected to the elastic segment 23, and a C-shaped portion 223 having two ends respectively connected to the internal portion 221 and the external portion 222. The internal portion 221 and the external portion 222 of the curved segment 22 in the present embodiment are two elongated structures substantially parallel to each other, so that the curved segment 22 is substantially a U-shape straddling a part of the corresponding side wall 112, but the present disclosure is not limited thereto.

Specifically, the internal portion 221 is arranged in the corresponding terminal slot 113 of the inserting chamber 11, and the internal portion 221 faces the groove 1122 of the corresponding terminal slot 113, so that the internal portion 221 is spaced apart from the corresponding side wall 112. The external portion 222 and the C-shaped portion 223 are arranged outside the inserting chamber 11, and the external portion 222 (i.e., the second end) is fastened to the corresponding fixing portion 1121 and abutted against the outer surface of the corresponding side wall 112.

It should be noted that the external portion 222 in the present embodiment is wedged into the corresponding fixing portion 1121, but the connection of the external portion 222 and the corresponding fixing portion 1121 in the present disclosure can be changed according to practical requirements and is not limited to the present embodiment.

The elastic segment 23 is arranged outside the inserting chamber 11, and a width of the elastic segment 23 in the present embodiment is the minimum width of the conductive terminal 2. In the present embodiment, the elastic segment 23 is substantially a U-shape, and a central axis C23 of the elastic segment 23 and a central axis C22 of the curved segment 22 (or the height direction H) have an acute angle $\alpha$ within a range of 30-60 degrees.

Moreover, a corner formed by the elastic segment 23 and the curved segment 22 has a first angle $\alpha 1$ within a range of 120-150 degrees, a corner formed by the elastic segment 23 and the fixing segment 24 has a second angle $\alpha 2$, and a difference between the first angle $\alpha 1$ and the second angle $\alpha 2$ is smaller than or equal to 5 degrees. In the present embodiment, the first angle $\alpha 1$ is substantially equal to the second angle $\alpha 2$, but the present disclosure is not limited thereto.

The fixing segment 24 is arranged outside the inserting chamber 11, and the fixing segment 24 in the present embodiment is an L-shape suitable for the surface mounting technology (SMT), but the present disclosure is not limited thereto. For example, in other embodiments of the present disclosure, the fixing segment 24 can be a structure suitable for inserting into and being soldered on an object (e.g., a circuit board).

In addition, a portion of the contact segment 21 (i.e., the bottom portion of the extending sheet 211 as shown in FIG. 5) arranged adjacent to the curved segment 22 extends from the curved segment 22 in a first direction D1, a portion of the fixing segment 24 (i.e., the top portion of the fixing segment 24 as shown in FIG. 5) arranged adjacent to the elastic segment 23 extends from the elastic segment 23 in a second direction D2, and the first direction D1 and the second direction D2 in the present embodiment are parallel to each other and extend in two opposite directions (i.e., the first direction D1 is an upward direction, the second direction D2 is a downward direction, and the first direction D1 and the second direction D2 are parallel to the height direction H).

Figure 7:
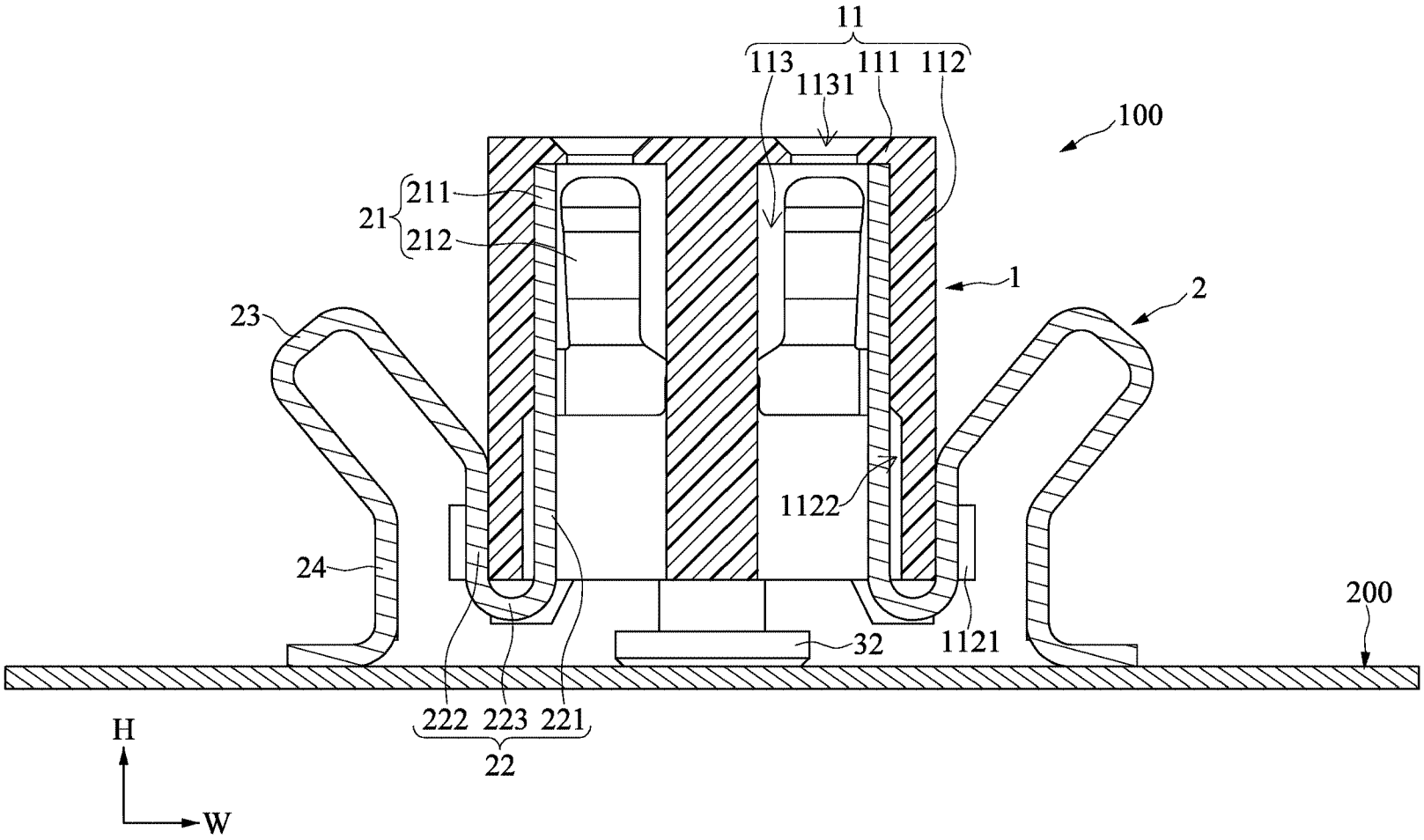
FIG. 7 is a cross-sectional view showing the floating connector being mounted on a circuit board.

The structure of the single conductive terminal 2 has been disclosed in the above description, and the following description discloses the connection between the conductive terminals 2 and other components. As shown in FIG. 7, bottom surfaces of the fixing segments 24 of the conductive terminals 2 are substantially arranged on a plane (e.g., a board surface of a circuit board), and the inserting chamber 11 is spaced apart from the plane. Specifically, the bottom surfaces of the fixing segments 24 of the conductive terminals 2 are provided for being fixed on a circuit board 200, and the inserting chamber 11 is spaced apart from the circuit board 200.

Accordingly, the insulating housing 1 (or the inserting chamber 11) is movable relative to the fixing segments 24, so that each of the elastic segments 23 can be pressed for providing an elastic force to the insulating housing 1 (or the inserting chamber 11). Specifically, the external portion 222 of each of the conductive terminals 2 and the corresponding fixing portion 1121 are cooperated with each other to form a fulcrum, so that when the insulating housing 1 and the portion of each conductive terminal 2 arranged in the insulating housing 1 are moved, the elastic segment 23 of each conductive terminal 2 can provide the elastic force to maintain the connection of the contact segment 21 of each conductive terminal 2 and the corresponding terminal of the mating connector.

Moreover, in each of the conductive terminals 2, a projecting region, which is defined by orthogonally projecting a corner of the elastic segment 23 arranged away from the inserting chamber 11 onto the circuit board 200 in the height direction H, is arranged outside the fixing segment 24.

As shown in FIGS. 2, 7, and 8, the two positioning posts 3 are respectively and movably inserted into the two positioning chambers 12. A bottom surface of each of the two positioning posts 3 passes through the corresponding positioning chamber 12, and the bottom surface of each of the two positioning posts 3 and the bottom surface of the fixing segment 24 of each of the conductive terminals 2 are configured for being fixed on the circuit board 200. It should be noted that the material of each positioning post 3 is preferably a metal, so that the bottom surface of each positioning post 3 can be soldered on the circuit board 200, but the present disclosure is not limited thereto. For example, in other embodiments of the present disclosure, the material of each positioning post 3 can be plastic, and each positioning post 3 is fixed to the circuit board 200 by wedging or screwing.

Specifically, in each of the two positioning posts 3 and the corresponding positioning chamber 12 of the present embodiment, the positioning post 3 includes a limiting portion 31 and a supporting portion 32 connected to the limiting portion 31. Moreover, a cross section of the limiting portion 31 perpendicular to the height direction H is larger than a cross section of the supporting portion 32 perpendicular to the height direction H. The cross section of the limiting portion 31 is larger than the small opening 1212 and is smaller than the big opening 1211, and the cross section of the supporting portion 32 is smaller than the small opening 1212.

Thus, in each positioning post 3 and the corresponding positioning chamber 12 of the present embodiment, an upper part of the supporting portion 32 is arranged in the lower half space of the positioning chamber 12, a lower part of the supporting portion 32 passes through the small opening 1212, and the limiting portion 31 is arranged in the upper half space of the positioning chamber 12 and is limited in the positioning chamber 12.

Specifically, when the insulating housing 1 of the floating connector 100 is not moved, the limiting portion 31 of each positioning post 3 is spaced apart from an inner surface of the corresponding positioning chamber 12. When the floating connector 100 is moved relative to the mating connector, the moving range of the insulating housing 1 is limited to the limiting portion 31 of each positioning post 3. In other words, when the insulating housing 1 is moved too far, the inner surface of each positioning chamber 12 (i.e., the limiting step surface 1213) will abut against the limiting portion 31 of the corresponding positioning post 3, so that the insulating housing 1 cannot be further moved.

The two end covers 4 are respectively and detachably fastened to the two positioning chambers 12 of the insulating housing 1 so as to respectively shield the two big openings 1211, thereby preventing the two positioning posts 3 from falling outside the range of the two positioning chambers 12 through the two big openings 1211. Moreover, the outer surface of each end cover 4 is preferably flush with the adjacent surface of the insulating housing 1, but the present disclosure is not limited thereto.

In addition, in other embodiments of the present disclosure, the insulating housing 1 can be further formed with a projective case extending outwardly from the inserting chamber 11, and the elastic segments 23 of the conductive terminals 2 can be substantially arranged in the projective case and not in contact with the projective case, so that the conductive terminals 2 can be protected by the projective case.

[The Effects of the Present Embodiments]

In summary, the floating connector and the conductive terminal of the present disclosure can be provided with a better shockproof effect by the structural design of the conductive terminal. Moreover, the cooperation of the conductive terminals and the inserting chamber (e.g., a part of each conductive terminal fastened to the inserting chamber is only located at one side of the elastic segment, and the elastic segments of the conductive terminals are arranged outside the inserting chamber) can be provided to prevent the insulating housing from limiting the performance of the conductive terminals, thereby effectively improving the shockproof effect of the floating connector.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A floating connector, comprising:

an insulating housing including an elongated inserting chamber defining a longitudinal direction, wherein the inserting chamber includes a top wall and two opposite side walls, each of the two side walls has a plurality of fixing portions arranged on an outer surface thereof, and the fixing portions of each of the two side walls are arranged in one row parallel to the longitudinal direction and arranged away from the top wall; and a plurality of conductive terminals respectively fastened to the fixing portions of the inserting chamber and arranged in two rows each parallel to the longitudinal direction, wherein each of the conductive terminals is integrally formed as one piece and includes:

a contact segment inserted into the inserting chamber in a height direction;

a curved segment having a first end connected to the contact segment and an opposite second end fixed on the corresponding fixing portion; and an elastic segment and a fixing segment both arranged outside the inserting chamber, wherein two opposite ends of the elastic segment are respectively connected to the second end of the curved segment and the fixing segment, wherein the conductive terminals are arranged in a mirror symmetry with respect to the inserting chamber, bottom surfaces of the fixing segments of the conductive terminals are substantially arranged on a plane, and the inserting chamber is spaced apart from the plane, wherein the insulating housing is movable relative to the fixing segments, so that each of the elastic segments can be pressed for providing an elastic force to the insulating housing.

2. The floating connector as claimed in claim 1, further comprising two positioning posts, wherein the insulating housing includes two positioning chambers respectively arranged at two opposite sides of the inserting chamber, and the two positioning posts are respectively and movably inserted into the two positioning chambers, wherein a bottom surface of each of the two positioning posts passes through the corresponding positioning chamber, and the bottom surface of each of the two positioning posts and the bottom surface of the fixing segment of each of the conductive terminals are configured for being fixed on a circuit board.

3. The floating connector as claimed in claim 2, wherein in each of the two positioning posts and the corresponding positioning chamber, the positioning post includes a limiting portion and a supporting portion connected to the limiting portion, the positioning chamber has a big opening and a small opening respectively arranged on two opposite sides thereof, a cross section of the limiting portion perpendicular to the height direction is larger than the small opening and is smaller than the big opening, the limiting portion is limited in the positioning chamber, a cross section of the supporting portion perpendicular to the height direction is smaller than the small opening, and a part of the supporting portion passes through the small opening.

4. The floating connector as claimed in claim 1, wherein the contact segment of each of the conductive terminals includes an extending sheet and two clamping sheets respectively extending from two opposite side edges of the extending sheet, the extending sheet of each of the conductive terminals is flatly abutted against an inner surface of the corresponding side wall, and the top wall has a plurality of insertion openings respectively corresponding in position to the conductive terminals, wherein the extending sheet and free ends of the two clamping sheets of each of the conductive terminals are arranged outside a projecting space defined by orthogonally projecting the corresponding insertion opening in the height direction.

5. The floating connector as claimed in claim 1, wherein each of the two side walls has a plurality of grooves formed in an inner surface thereof and arranged away from the top wall, and the curved segment of each of the conductive terminals includes an internal portion connected to the contact segment and an external portion fixed on the corresponding fixing portion, wherein the internal portions of the conductive terminals respectively face the grooves of the two side walls, and the internal portion of each of the conductive terminals is spaced apart from the corresponding side wall.

6. The floating connector as claimed in claim 1, wherein in each of the conductive terminals, the elastic segment is substantially a U-shape, and a central axis of the elastic segment and the height direction have an acute angle within a range of 30-60 degrees.

7. The floating connector as claimed in claim 1, wherein in each of the conductive terminals, a corner formed by the elastic segment and the curved segment has a first angle within a range of 120-150 degrees, a corner formed by the elastic segment and the fixing segment has a second angle, and a difference between the first angle and the second angle is smaller than or equal to 5 degrees.

8. A conductive terminal of a floating connector, comprising:

a contact segment;

a curved segment substantially being a U-shape and having a first end and an opposite second end, wherein the first end is connected to the contact segment; and an elastic segment and a fixing segment, wherein two opposite ends of the elastic segment are respectively connected to the second end of the curved segment and the fixing segment, the elastic segment is substantially a U-shape, and a central axis of the elastic segment and a central axis of the curved segment have an acute angle, wherein a portion of the contact segment arranged adjacent to the curved segment extends from the curved segment in a first direction, a portion of the fixing segment arranged adjacent to the elastic segment extends from the elastic segment in a second direction, and the first direction and the second direction are parallel to each other and extend in two opposite directions, and wherein a corner formed by the elastic segment and the curved segment has a first angle within a range of 120-150 degrees, a corner formed by the elastic segment and the fixing segment has a second angle, and a difference between the first angle and the second angle is smaller than or equal to 5 degrees.

* * * * *